US005787678A

United States Patent [19]

Koike et al.

[11] Patent Number: 5,787,678

[45] Date of Patent: Aug. 4, 1998

[54] DRUG PACKAGING DEVICE

[75] Inventors: Naoki Koike; Hirotaka Hayashi, both of Toyonaka, Japan

[73] Assignee: Kabushiki Kaisha Yuyama Seisakusho, Osaka, Japan

[21] Appl. No.: 848,862

[22] Filed: May 1, 1997

[51] Int. Cl.[6] ..... B65B 35/54

[52] U.S. Cl. ..... 53/154; 53/168; 53/237; 53/493; 221/124; 221/133

[58] Field of Search ..... 53/154, 155, 168, 53/237, 238, 248, 493; 221/12, 93, 94, 95, 124, 129, 133, 252, 296

[56] References Cited

U.S. PATENT DOCUMENTS 5,097,652 3/1992 Inamura et al. ..... 53/493
5,348,061 9/1994 Riley et al. ..... 221/129 X
5,481,855 1/1996 Yuyama ..... 53/493
5,502,944 4/1996 Kraft et al. ..... 53/168 X
5,533,606 7/1996 Yuyama ..... 53/168 X
5,660,305 8/1997 Lasher et al. ..... 53/168 X
5,671,592 9/1997 Yuyama et al. ..... 53/493
5,678,393 10/1997 Yuyama et al. ..... 53/493

*Primary Examiner*—Daniel Moon
*Attorney, Agent, or Firm*—Wenderoth, Lind & Ponack, L.L.P.

[57] ABSTRACT

A drug packaging device having a shutter provided in a guide path which can prevent drugs from rebounding from the shutter once they land on the shutter so that they can settle on the shutter as quickly as possible. The shutter is made up of a plate-shaped body made from a soft, flexible silicone resin, and a Teflon resin coating layer formed on the body. Such a shutter can absorb shocks when drugs land on the shutter and prevent them from rebounding when they land on the shutter. Thus, drugs stabilize quickly after they land on the shutter.

5 Claims, 4 Drawing Sheets

DRUG PACKAGING DEVICE

BACKGROUND OF THE INVENTION

This invention relates to a drug packaging device including a plurality of drug feeders in which are stored different kinds of drugs such as tablets, capsules or vials and adapted to feed prescribed drugs from the drug feeders and package them. Specifically, this invention relates to a drug packaging device provided with a shutter in each guide path through which drugs discharged from the feeders drop into a packaging unit for temporarily supporting the drugs dropping through the guide path.

Conventional drug packaging device of the above type have a plurality of shutters mounted in each drug guide path at different levels. Each shutter is a plate member large enough to close the guide path and pivotable about the axis connecting the centers of its side edges. Each shutter is pivoted by a drive means connected to its rotary shaft between open and closed positions.

In the closed position, each shutter is inclined with its both ends in contact with the opposite inner surfaces of the guide path, thus closing the guide path. In the open position, in which each shutter is vertically positioned with both ends not in contact with the inner surface of the guide path, the guide path is opened. The shutters are pivoted between the open and closed positions by their respective drive means.

When closed, each shutter receives drugs dropping through the guide path. By opening each shutter, drugs on the shutter drop into the packaging unit. Drugs discharged from a selected feeder are temporarily received on the shutter. In this state, the shutter is momentarily opened to drop the drugs thereon and is soon closed. With this arrangement, it is possible to discharge new drugs soon after the drugs on the shutter has been dropped. Since the distance between the adjacent shutters is less than half the distance between the hopper and the highest feeder, it is possible to greatly improve the drug packaging efficiency.

If these shutters are made from a hard material, they will produce much noise when they are pivoted to closed position because their ends collide with the inner surface of the guide path. Thus, most conventional shutters are made from a soft material such as silicone resin.

But a soft shutter has a problem in that drugs tend to rebound repeatedly from the wall after they land on the shutter. Thus, it takes a long time until drugs settle on the shutter. If the shutter is opened while drugs are rebounding from the shutter, some of the drugs may remain on the shutter because the shutter is opened only momentarily. This makes difficult quick delivery of drugs into the packaging unit. Moreover, if some drugs remain on the shutter when the shutter is opened, these drugs will mix with drugs subsequently discharged from a different feeder. If this happens, wrong drugs will be prescribed to a patient.

An object of this invention is to prevent drugs from rebounding from the shutter once they land on the shutter so that they can settle on the shutter as quickly as possible.

SUMMARY OF THE INVENTION

According to this invention, the shutter comprises a body made from a shock-absorbable material and a coating layer provided on the surface of the body and made from a material harder than the shock-absorbable material. Preferably, the shutter has a smooth top surface. The body is preferably made from a flexible silicone resin and the coating layer from Teflon resin.

When drugs land on the shutter, the flexible silicone resin resiliently deforms together with the harder Teflon resin, thereby absorbing shocks inflicted by the falling drugs. The hard Teflon resin layer allows the deformed shutter to slowly move back to the original state, so that the shutter's movement subsides in a short time. Drugs on the shutter will not rebound.

In order to provide a smooth top surface, a sheet of Teflon resin may be laminated on the body. With this arrangement, drugs can smoothly slide and fall from the shutter.

Other features and objects of the present invention will become apparent from the following description made with reference to the accompanying drawings, in which:

DETAILED DESCRIPTION OF THE PREFERRED EMBODIMENT

An embodiment of this invention will now be described with reference to the accompanying drawings.

Figure 1:
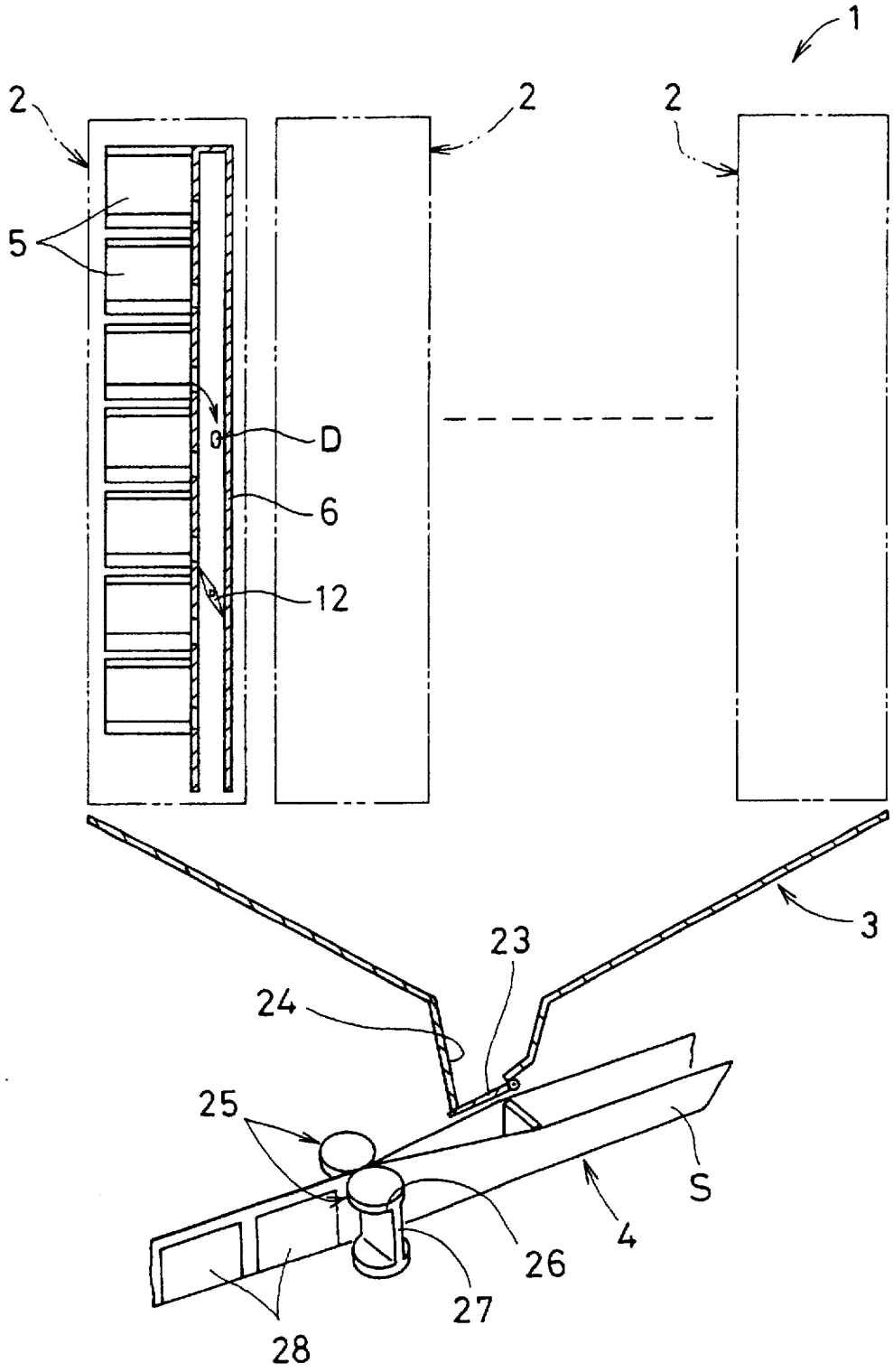
FIG. 1 is a schematic view of an embodiment of the drug packaging device according to this invention.

The drug packaging device 1 shown in FIG. 1 includes a housing in which are mounted drug feed units 2 arranged in a plurality of lateral rows, a hopper 3 for collecting drugs dropped from the drug feed units 2, and a packaging unit 4 for packaging drugs collected into the hopper 3.

Each of the drug feed units 2 comprises a plurality of drug feeders 5 provided one atop another. The feeders 5 discharge a predetermined number of prescribed drugs into a common drug guide path 6 through which drugs discharged drop into the hopper 3. The drug feed unit 2 may be arranged in a straight line or in a circle.

Figure 2:
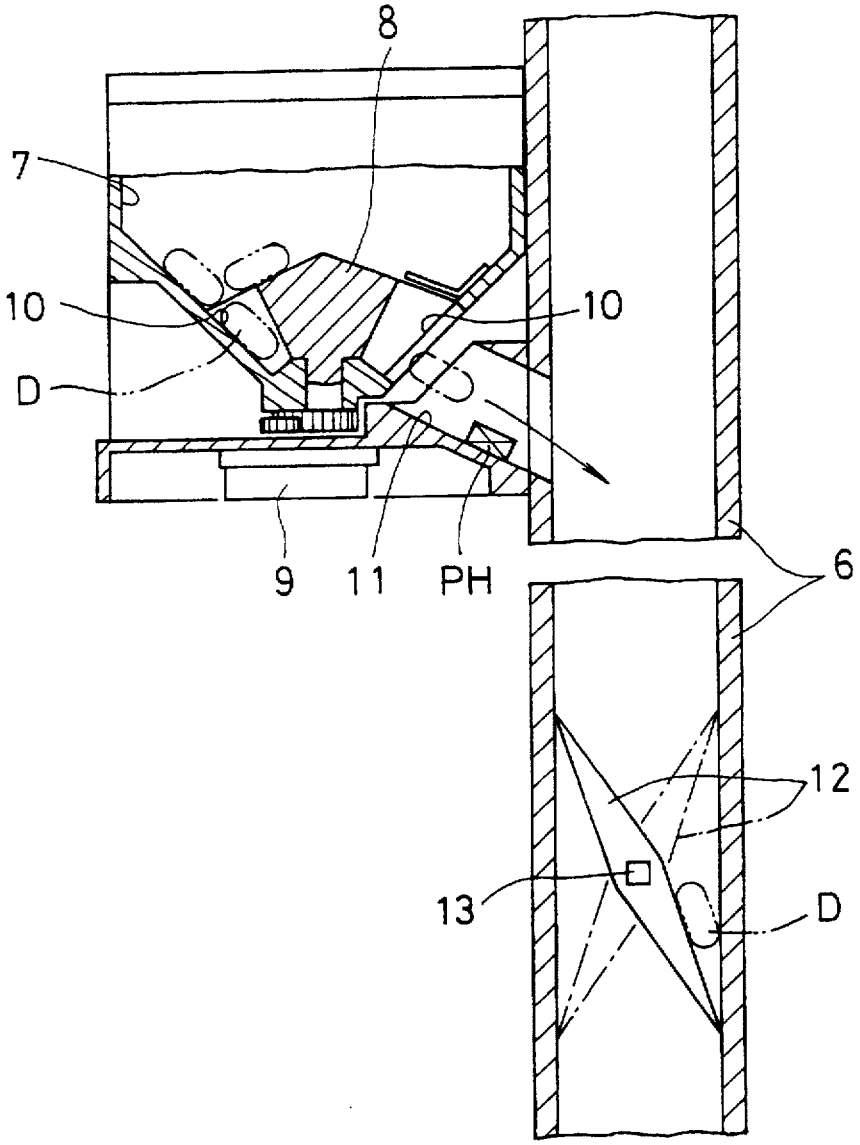
FIG. 2 is a sectional view of a drug feeder and a shutter in a guide path.

Referring to FIG. 2, each drug feeder 5 comprises a drug storage case 7, a rotor 8 mounted on the inner bottom of the case 7 and rotated by a motor 9. The rotor 8 has a plurality of pockets 10 formed in the outer periphery thereof. As the rotor 8 is rotated, drugs D in the case 7 move into the pockets 10 and are discharged one by one through a discharge passage 11 into the guide path 6.

A sensor PH provided in the discharge passage 11 detects the passage of each drug D. When the sensor PH counts a predetermined number of drugs, the motor 9 stops to stop discharging drugs.

As shown in FIGS. 1 and 2, a plate-shaped shutter 12 having a section tapering toward both ends is provided in the guide path 6. When the shutter 12 is inclined as shown in FIG. 2, it closes the guide path 6 with its both ends abutting the opposed inner faces of the guide path 6. In this state, the shutter 12 defines a wedge-shaped space in which drugs fit.

The shutter 12 is mounted so as to be pivotable about a shaft 13 extending along a transverse center axis of the shutter 12 between open and closed positions. In the closed position, the shutter has its both ends in contact with the opposed inner faces of the guide path, so that drugs land thereon. In the open position, both ends of the shutter are separate from the opposed faces of the guide path, so that drugs can drop.

Figure 3A:
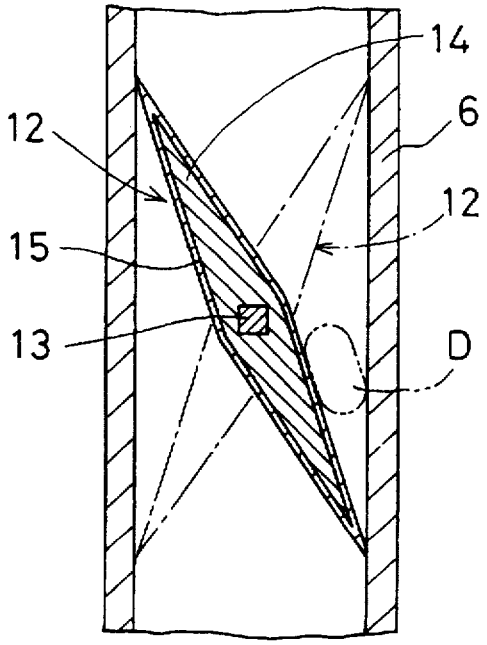
FIG. 3A is a sectional view of a shutter.

Referring to FIG. 3A, the shutter 12 is a double-layer construction and comprises a plate-shaped body 14 made from flexible silicone resin, and a hard Teflon resin coating layer 15 formed on the body 14 by baking. When drugs D falling from the drug feeders 5 land on the shutter 12, the hard Teflon resin coating layer 15 and the flexible silicone resin body 14 resiliently deform, thus absorbing shocks inflicted by the falling drugs. Drugs D are thus kept damage-free. The hard Teflon resin coating layer 15 allows the deformed body 14 to slowly move back to the original state so that the shutter's movement subsides in a short time. Thus the drugs on the shutter will not rebound but stand still in a short time.

The soft flexible body of the shutter 12 enables the shutter to come into contact with the opposed faces of the guide path 6 without causing noise. Due to smooth top surface of the Teflon resin layer 15, drugs on the shutter can smoothly slide and fall from the shutter.

Since the shutter 12 is pivotable about a transverse center axis, it can move from one of the two closed positions to the open position and then to the other closed position, shown by chain line in FIG. 3A, by pivoting in one direction. The shutter can thus move quickly between the open and closed positions, so that drugs can be speedily supplied into the hopper 3 and the packaging unit 4.

Figure 3B:
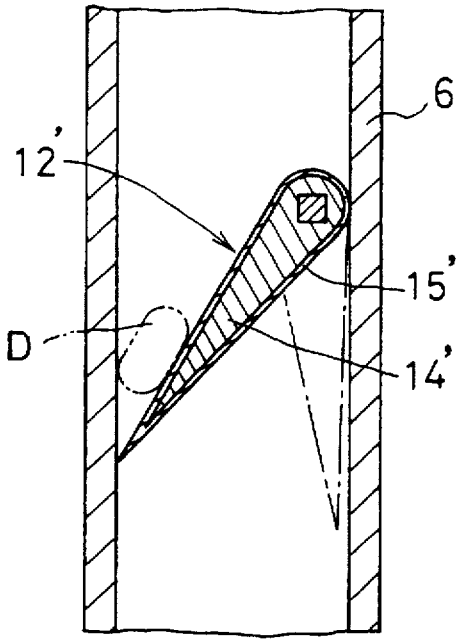
FIG. 3B is a sectional view of a shutter of a different type.

But instead, the shutter 12' may be pivotally supported on a shaft provided alongside of one end of the shutter, as shown in FIG. 3B. In this arrangement, the shutter is pivoted in one direction to move it from the closed position to the open position shown by chain line, and pivoted in the opposite direction to move it from the open to closed position.

Figure 4:
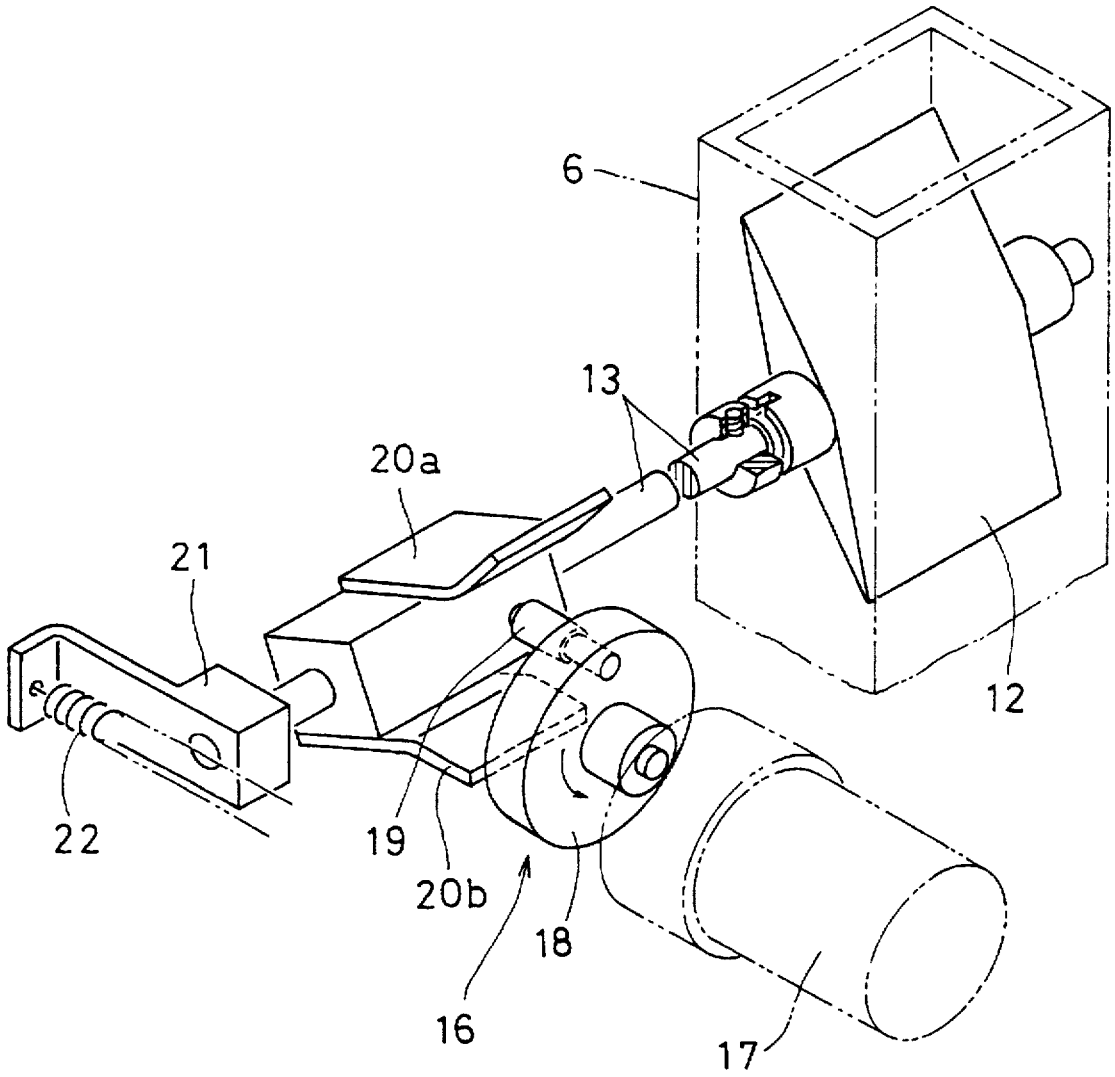
FIG. 4 is a sectional view of a shutter pivoting mechanism.

As shown in FIG. 4, the shutter 12 is pivoted open and shut by a driving means 16 connected to the rotary shaft 13.

The driving means 16 comprises a motor 17 having a disk 18 mounted on its rotary shaft. The disk 18 carries a pin 19 near its circumference. The shaft 13 carries a first plate member **20*a* and a second plate member 20*b* provided axially offset from the first plate member 20*a*. As the disk 18 rotates, the pin 19 alternately comes into contact with the inner surfaces of the first and second plate members 20*a*, 20*b*, thus pushing up and down the members 20*a*, 20*b*, respectively. When the first plate member 20*a* is raised, the shutter 12 pivots in one of the two closed positions. When the second plate member 20*b* is pushed down, the shutter pivots in the opposite direction to the other closed position. The shaft 13 has an arm 21 at one end to which is connected a spring 22. The spring biases the shaft 13 to hold the shutter 12 in either of the two closed positions. While pivoting from one closed position to the other, the shutter 12** opens and drugs on the shutter drop.

Referring back to FIG. 1, the hopper 3 has a discharge opening 24 at its bottom which is covered by a door member 23 which is opened and closed by an unillustrated drive means.

As shown in FIG. 1, the packaging unit 4 includes a pair of heat rolls 25. Pressed against each other, the rolls 25 rotate in opposite directions to each other. A long packaging sheet S is folded in two along the longitudinal centerline with its opening facing up, and inserted between the rolls 25. The packaging sheet S is formed from a heat-sealable laminate film. Its overlapping side edges are continuously heat-sealed together by circular heating surfaces 26 formed along the top edges of the rolls 25. Also, the packaging sheet is heat-sealed along longitudinally spaced transverse lines by a pair of heating surfaces 27 formed on either of the rolls 25.

The packaging sheet S is fed at a constant speed between the heat rolls 25. When one transverse seal line is formed, drugs stored in the hopper 3 are dumped into the space defined behind the transverse seal line. Then, with the drugs put in this space, the top and rear side of this space are heat-sealed to form a bag 28.

The drug packaging device 1 has a control unit (not shown), which selects a feeder that stores prescribed drugs and discharge a predetermined number of drugs from this feeder. The shutter 12 and the door member 23 are opened simultaneously when a predetermined time has passed since the feeder 5 began discharging drugs. Drugs in the hopper 3 are supplied into the packaging unit 4 through the discharge opening 24 of the hopper 3 and packaged.

The abovementioned predetermined time is the longer one of the time elapsed until drugs D discharged from any drug feeder 5 located above the shutter 12 land on the shutter 12, and the time elapsed until drugs falling from the shutter is received on the door member 23 of the hopper 3.

In this arrangement, the step of dropping drugs on the shutter 12 into the hopper 3 and the step of discharging drugs from a selected drug feeder 5 onto the shutter 12 are carried out simultaneously. The shutter 12 and the door member 23 are opened upon completion of one of these steps which takes a longer time. It is thus possible to efficiently package drugs even if the distance from the selected drug feeder 5 to the hopper 3 is long.

In the closed position, i.e. the position in which both ends of the shutter 12 are in contact with the opposed faces of the guide path, the shutter 12 defines a downwardly tapering wedge-shaped space in cooperation with the inner surface of the guide path. Due to this wedge-shaped space and the double-layer structure of the shutter comprising the soft silicone resin body and the hard Teflon resin layer, drugs can soft-land on the shutter without encountering any major impact and settle in a short time without rebounding. Thus, with this arrangement, if the time elapsed until drugs discharged from a selected feeder land on the shutter and settle is used as the abovementioned predetermined time, it is possible to shorten this time and thus the entire processing time. Once drugs land on the sheet, they will not rebound. This makes it possible to supply drugs quickly into the packaging unit 4 and also prevent drugs on the shutter from mixing with drugs discharged from another feeder.

The flexible shutter 12 can come into the opposed faces of the guide path 6 with a minimum noise and will not damage drugs that land on the shutter.

In this embodiment, a single shutter 12 is provided in each guide path 6. But a plurality of them may be provided in each guide path at different levels to further improve processing efficiency.

According to this invention, the shutter absorbs shocks when drugs land on the shutter while preventing drugs from rebounding from the shutter. Drugs thus stabilize in an extremely short time. This makes it possible to deliver drugs quickly to the packaging unit and to prevent drugs on the shutter from mixing with drugs discharged from a different feeder.

What is claimed is:

1. A drug packaging device comprising a plurality of drug feeders for storing drugs, a guide path through which drugs discharged from any of said drug feeders drop, a shutter provided in said guide path so as to be movable between a closed position and an open position and adapted to receive drugs discharged from any of said feeders when it is in the closed position and allow the drugs thereon to drop when moved to the open position, a shutter drive means for moving said shutter between the open and closed positions, and a packaging unit provided under said guide path for receiving and packaging drugs dropped from said shutter when said shutter is moved to the open position by said shutter drive means, said shutter comprising a body made from a shock-absorbable material and a coating layer provided on the surface of said body and made from a material harder than said shock-absorbable material.

2. A drug packaging device as claimed in claim 1 wherein said shutter has a smooth top surface.

3. A drug packaging device as claimed in claim 2 wherein said body is made from a flexible silicone resin and said coating layer is made from Teflon resin.

4. A drug packaging device as claimed in claim 3 wherein said Teflon coating layer is formed by baking.

5. A drug packaging device as claimed in claim 2 wherein said body is made from a silicone resin, and said coating layer is a sheet of Teflon resin laminated on said body.

* * * * *